US011118863B2

(12) United States Patent
Patel et al.

(10) Patent No.: US 11,118,863 B2
(45) Date of Patent: Sep. 14, 2021

(54) EXTREME LONG-RANGE SNIPER ENGAGEMENT

(71) Applicants: Jagrut Patel, Weston, FL (US); Sumeet Suri, New Castle, WA (US)

(72) Inventors: Jagrut Patel, Weston, FL (US); Sumeet Suri, New Castle, WA (US)

( * ) Notice: Subject to any disclaimer, the term of this patent is extended or adjusted under 35 U.S.C. 154(b) by 0 days.

(21) Appl. No.: 16/721,864

(22) Filed: Dec. 19, 2019

(65) Prior Publication Data

US 2021/0190456 A1 Jun. 24, 2021

(51) Int. Cl.
*F41G 1/34* (2006.01)
*F41G 1/38* (2006.01)

(52) U.S. Cl.
CPC ..... *F41G 1/345* (2013.01); *F41G 1/38* (2013.01)

(58) Field of Classification Search
CPC ... F41G 1/32; F41G 1/34; F41G 1/345; F41G 1/36; F41G 1/38; F41G 1/387
USPC ..... 42/124, 125, 126, 127, 128
See application file for complete search history.

(56) References Cited

U.S. PATENT DOCUMENTS 5,079,646 A * 1/1992 Schwartz ..... F41G 1/38 359/819
5,937,562 A * 8/1999 Brough ..... G02B 23/12 250/206
7,367,152 B2 * 5/2008 Samson ..... F41C 27/00 42/128
7,870,688 B1 * 1/2011 Dasiukevich ..... F41G 11/004 42/124
7,908,782 B1 * 3/2011 LaRue ..... F41G 11/003 42/128
8,510,983 B2 * 8/2013 Larue ..... F41G 11/003 42/148
8,793,921 B1 * 8/2014 Tonello ..... F41G 11/008 42/125
2014/0109458 A1 * 4/2014 Maryfield ..... G01S 17/74 42/119
2015/0138633 A1 * 5/2015 Theisinger ..... G02B 23/16 359/399
2015/0146015 A1 * 5/2015 Sommerlade ..... G06T 7/73 348/187
2019/0129162 A1 * 5/2019 Hodelin ..... F41G 1/38
2019/0353455 A1 * 11/2019 McHale ..... H04N 5/33

* cited by examiner

*Primary Examiner* — Bret Hayes

(57) ABSTRACT

A system for extending range of target engagement is provided. The system comprises a long firearm with a day optic sight attached and a clip-on thermal sight installed forward of the day optic sight. The clip-on thermal sight receives rotation of 90 degrees lengthwise along the firearm, display orientation of view finder changed from horizontal to vertical, and improves, based at least on the rotation and changed orientation, the aspect ratio is favorably altered to increase number of vertical mils available for target engagement. The range and situational awareness are both simultaneously enhanced while maintaining the number of pixels on the target by increasing the sensor resolution.

4 Claims, 7 Drawing Sheets

PRIOR ART

PRIOR ART

300

| Range (yd) | Elevation (in) | Elevation (MIL) | Windage (MIL) | Time (s) | Energy (ft.lbf) | Vel[x+y] (ft/s) |
|---|---|---|---|---|---|---|
| 0 | -1.50 | 0.00 | 0.00 | 0.00 | 13246 | 2820 |
| 100 | 0.00 | 0.00 | 0.09 | 0.11 | 12433 | 2732 |
| 200 | -3.16 | 0.44 | 0.17 | 0.22 | 11663 | 2646 |
| 300 | -11.29 | 1.04 | 0.26 | 0.34 | 10931 | 2562 |
| 400 | -24.72 | 1.72 | 0.35 | 0.45 | 10235 | 2479 |
| 500 | -43.81 | 2.43 | 0.44 | 0.58 | 9575 | 2398 |
| 600 | -68.95 | 3.19 | 0.54 | 0.70 | 8948 | 2318 |
| 700 | -100.57 | 3.99 | 0.64 | 0.84 | 8353 | 2239 |
| 800 | -139.12 | 4.83 | 0.74 | 0.97 | 7789 | 2163 |
| 900 | -185.11 | 5.71 | 0.85 | 1.11 | 7256 | 2087 |
| 1000 | -239.08 | 6.64 | 0.96 | 1.26 | 6752 | 2013 |
| 1100 | -301.63 | 7.62 | 1.07 | 1.41 | 6276 | 1941 |
| 1200 | -373.42 | 8.64 | 1.19 | 1.57 | 5828 | 1871 |
| 1300 | -455.13 | 9.72 | 1.32 | 1.73 | 5408 | 1802 |
| 1400 | -547.73 | 10.87 | 1.44 | 1.90 | 5013 | 1735 |
| 1500 | -651.72 | 12.07 | 1.57 | 2.08 | 4644 | 1670 |
| 1600 | -768.19 | 13.34 | 1.71 | 2.26 | 4301 | 1607 |
| 1700 | -898.33 | 14.68 | 1.85 | 2.45 | 3982 | 1546 |
| 1800 | -1042.80 | 16.09 | 2.00 | 2.65 | 3686 | 1488 |
| 1900 | -1203.24 | 17.59 | 2.15 | 2.86 | 3414 | 1432 |
| 2000 | -1380.36 | 19.17 | 2.30 | 3.07 | 3163 | 1378 |
| 2100 | -1576.09 | 20.84 | 2.46 | 3.29 | 2935 | 1327 |
| 2200 | -1791.56 | 22.62 | 2.63 | 3.52 | 2729 | 1280 |
| 2300 | -2028.66 | 24.49 | 2.80 | 3.76 | 2543 | 1236 |
| 2400 | -2288.12 | 26.48 | 2.97 | 4.01 | 2379 | 1195 |
| 2500 | -2572.37 | 28.57 | 3.14 | 4.27 | 2233 | 1158 |
| 2600 | -2882.55 | 30.79 | 3.32 | 4.53 | 2107 | 1125 |
| - Sound Barrier (1116 fps) - | | | | | | |
| 2700 | -3220.76 | 33.12 | 3.49 | 4.80 | 1996 | 1095 |
| 2800 | -3587.99 | 35.58 | 3.67 | 5.08 | 1900 | 1068 |
| 2900 | -3986.34 | 38.16 | 3.85 | 5.37 | 1816 | 1044 |
| 3000 | -4416.59 | 40.87 | 4.02 | 5.66 | 1741 | 1022 |

Drag Function: G1
Ballistic Coefficient: 1.050
Bullet Weight: 750 gr
Initial Velocity: 2820 fps
Sight Height : 1.5 in
Shooting Angle: 0°

Wind Speed: 10 mph
Wind Angle: 90°
Zero Range: 100 yd
Chart Range: 3000 yd
Maximum Range: 10201 yd
Step Size: 100 yd International Standard Atmosphere
Altitude: Sea Level (0 ft)
Barometric Pressure: 29.92 Hg
Temperature: 59° F
Relative Humidity: 50%
Speed of Sound: 1116 fps

FIG. 3

EXTREME LONG-RANGE SNIPER ENGAGEMENT

FIELD OF THE INVENTION

The present disclosure is in the field of firearms. More particularly, the present disclosure provides systems and methods of manipulating a clip-on thermal weapon sight to significantly extend the user's effective range of target engagement.

BACKGROUND

Hunters, military snipers, and other users of firearms seeking to more frequently strike long range targets use scopes, sights and other instruments to improve their performance. Sighting devices referred to as thermographic weapon sights, thermal imagery scopes or thermal weapon sights combine a compact thermographic camera and an aiming reticle. They can be mounted on a variety of small arms as well as some medium caliber weapons.

Some thermal weapon sights are known as "clip-on" because they can be affixed atop a rifle ahead of the day sight or scope that may be a permanent part of the rifle. The day scope is able to adjust crosshairs whereas the thermal clip-on sight behaves as a pass-through device. FIG. 1 is an image of a sniper rifle 100 with a clip-on thermal sight 104 installed ahead or forward of the day sight or scope 102. The clip-on thermal sight 104 behaves as a pass through to the day scope 102.

An example of a known thermal sight is the HISS-XLR clip-on thermal weapon sight provided by FLIR Systems, Inc. depicted in FIG. 1. Per FLIR Systems, the HISS-XLR clip-on thermal weapon sight allows snipers to detect and recognize man-size targets in excess of 2,000 meters.

Technical Parameters for HISS-XLR are as follows:

FPA Resolution: 640×480 InSb

Pixel Pitch: 15 um

Focal Length: 240 mm

FOV: 2.3°×1.7°

DRI [Yards] for Human Target as per Johnson's Criteria for HISS-XLR

Detection: 9,915 Yards

Recognition: 3,098 Yards

Identification: 1,859 Yards

480 Vertical Pixels corresponds to 29.7 mils. Assuming the Optical Chain is zeroed at 100 m, a user has about 15 mils available to engage a target. An example of such a target is shown in FIG. 2 which illustrates a view finder for the HISS-XLR 200.

Based on the ballistic computation 300 for 50 BMG 750 gr Hornady A-Max bullets, the data in the table depicted in FIG. 3 indicate that maximum engagement distance for HISS-XLR would be about 1700 yards for 15 mils of elevation range. The personnel skilled in the art may realize that the limitation of engaging range at 1700 yards stated in the illustration above is due to the Field of View of the clip-on thermal imaging system as well as the trajectory of the bullet or a projectile. So even though the clip-on thermal imaging system is designed to observe a target at much greater distances there is a practical upper limit on how far such clip-on thermal imaging systems are able to engage the target.

Clip-on thermal sights 104 such as the HISS-XLR provide the view finder that is rectangular in shape 200 and depicted in FIG. 2. The rectangle is on its side such that the horizontal portion of the rectangle is longer than the vertical portion of the rectangle.

BRIEF DESCRIPTION OF THE DRAWINGS

FIG. 3 is a table of ranges or maximum engagement distances for a sample bullet type and listing assumptions associated with the sample bullet performance projection in accordance with the prior art.

DETAILED DESCRIPTION

Figure 1:
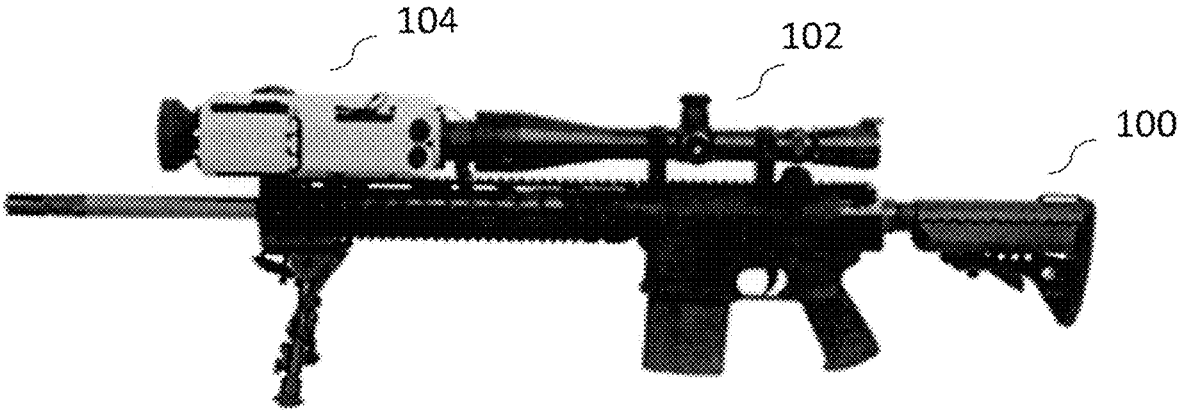
FIG. 1 is an image of a firearm and attached accessories in accordance with the prior art.
Figure 2:
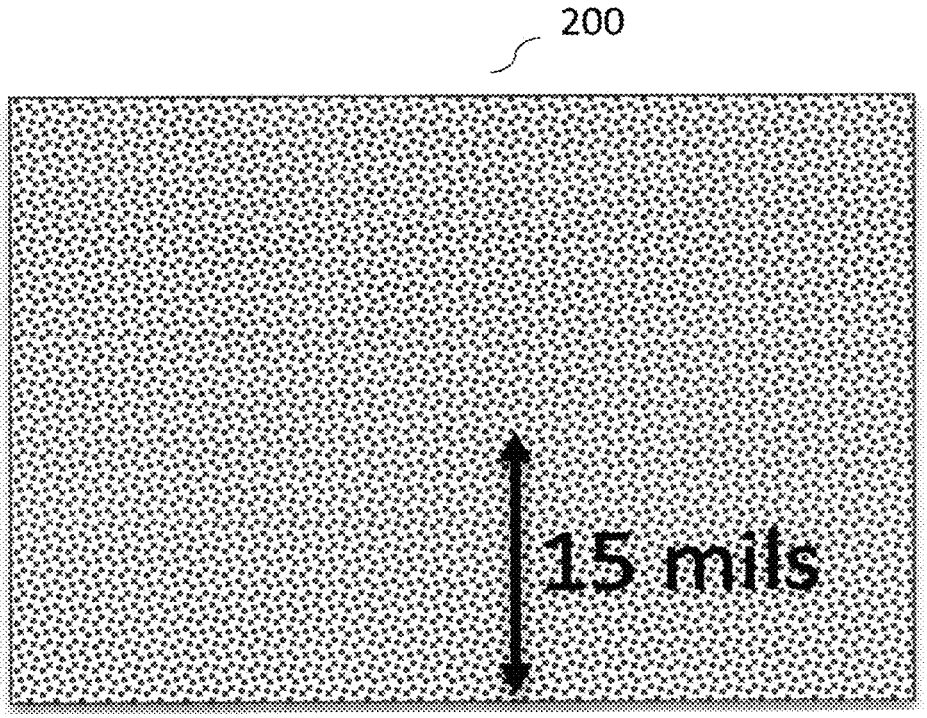
FIG. 2 is an image of a clip-on thermal sight view finder in accordance with the prior art.
Figure 4:
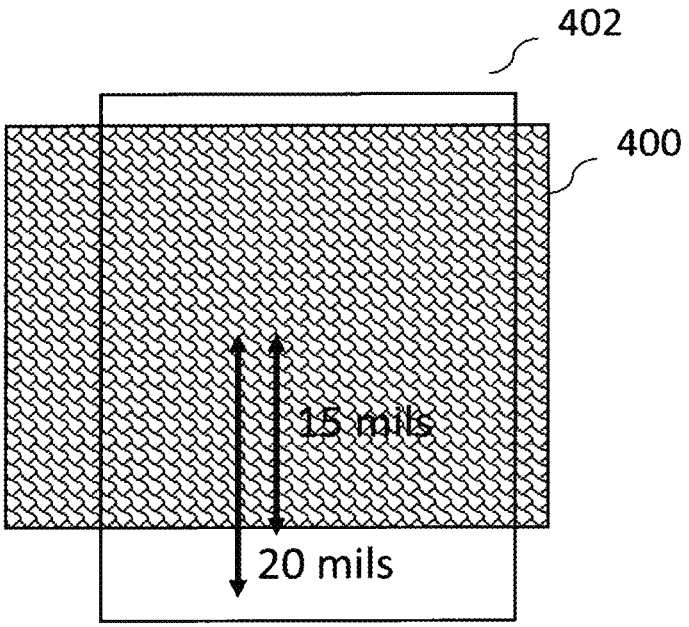
FIG. 4 is an image of a clip-on thermal sight view finder in accordance with the present disclosure.

Systems and methods described herein provide for a clip-on thermal weapon sight installed on a long firearm to be rotated 90 degrees on its axis along the length of the firearm. The FIG. 4 illustrates view finder, presented as a focal point array (FPA) image and which is seen as a rectangle on its side when the thermal sight is in its conventional upright position 400, is converted to a rectangle standing on its end by the rotation 402. This action alters the aspect ratio in the favor of the user and significantly extends the operator's target engagement range. This action may enable the user to strike more distant targets without sacrificing accuracy. Further, it shall be apparent that such alteration of aspect ratio shall reduce the situational awareness of the operator while enhancing the target engagement range.

Figure 5:
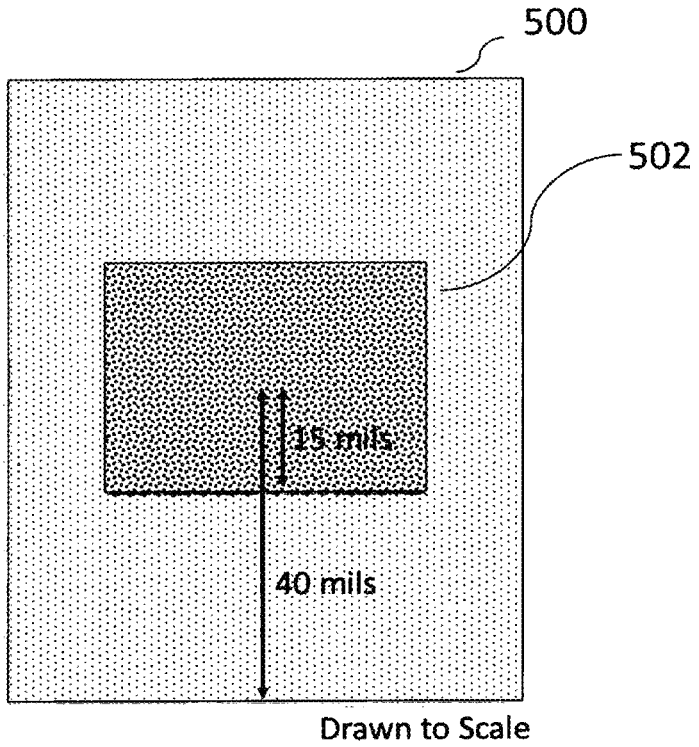
FIG. 5 is an image of an enhanced clip-on thermal sight view finder in accordance with the present disclosure.

The target engagement range of the clip-on thermal weapon sight is further enhanced while simultaneously increasing the situational awareness by using high definition thermal FPA with lower pixel pitch. FIG. 5 illustrates an Extreme Long Range Cooled Mid-Wave Clip-on Thermal Weapon Sight with up to 3,000 Yards, systems and methods achieve about 40 mils in elevation from the center of the view finder 500 as compared to 15 mils achieved by HISS-XLR 502. Systems and methods described herein may be directed to the Extreme Long-Range Clip-on Thermal Weapon Sight for SOF Operator using high definition (HD) detector.

The long firearm is one of a hunting rifle, a military sniper rifle, or other long range, long-barreled firearm. The rotation of 90 degrees may equate to HFOV 3.7° and VFOV 4.06°. The rotation improves elevation coverage by 250% and improves situational awareness by 160% 500 as shown in FIG. 5 while maintaining same number of pixels on target as compared to HISS-XLR 502. In FIG. 5, the view finder for the HISS-XLR is the smaller rectangle 502 with the darker shading and the view finder as provided by systems and methods disclosed herein is the larger rectangle 500 on its end. Based at least on the rotation and changed orientation of view finder, a user is provided a view based on 1280 pixels equating to 80 mils.

Technical parameters for systems provided herein are as follows:

FPA Resolution: 1280×1024 InSb

Pixel Pitch: 10 um

FOV: 4.6°×3.7°

Focal Length: 160 mm

DRI [Yards] for Human Target as per Johnson's Criteria for systems provided herein.

Detection: 9,915 Yards

Recognition: 3,098 Yards

Identification: 1,859 Yards

Figure 6:
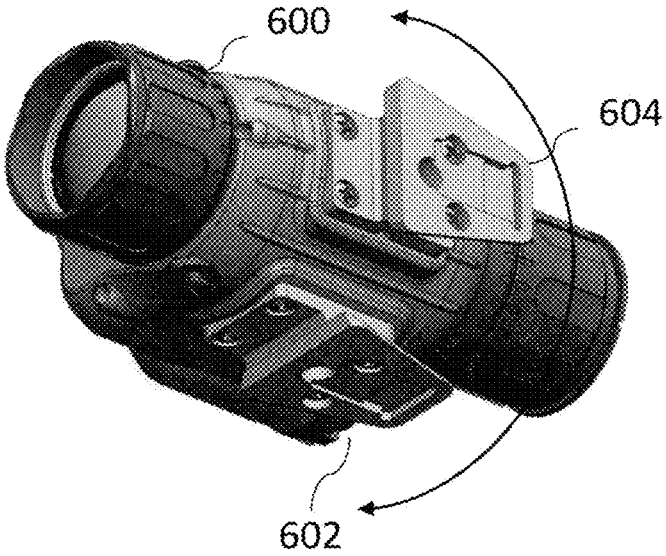
FIG. 6-FIG. 7 are images of a clip-on thermal sight in accordance with the present disclosure.
Figure 7:
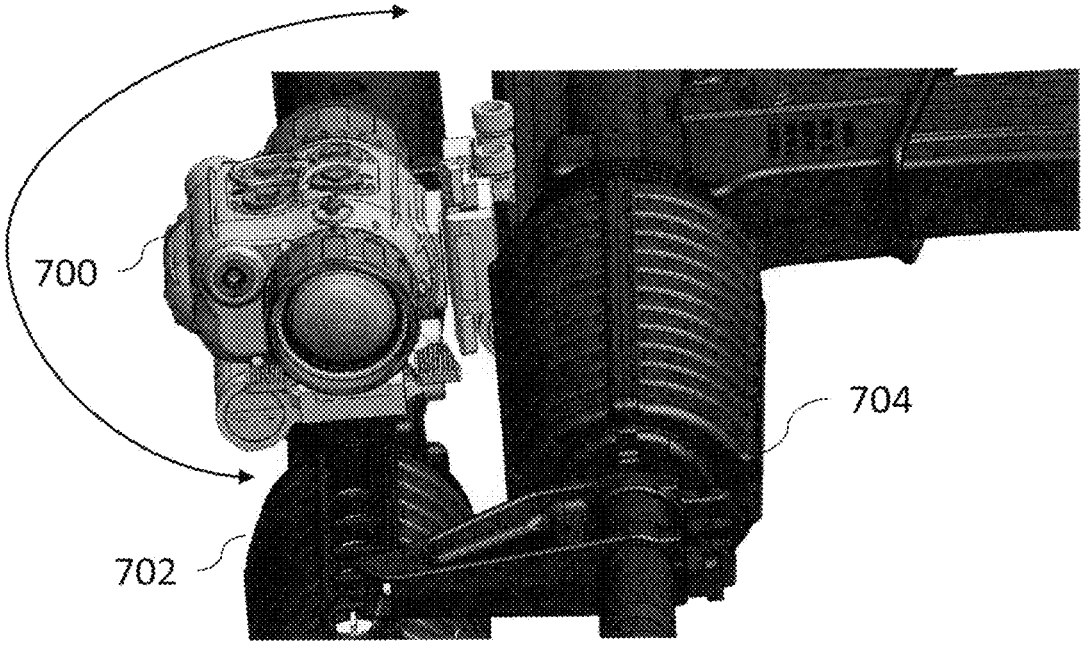

FIG. 6-FIG. 7 are images of a clip-on thermal sight in accordance with the present disclosure. FIG. 6 depicts how the clip-on thermal sight 600 is designed with provision of dual mounting brackets i.e. bottom of the sight 602 as well as at 90 degree rotation 604.

FIG. 7 is an image of the clip-on thermal sight 700 situated on the firearm with normal orientation 702 and with 90 degree rotational orientation 704.

In an embodiment an orientation sensor is installed in the clip-on sight and detects when the sight has shifted from horizontal to vertical orientation. The sensor communicates to components in the thermal sight that menus including overlays have been automatically adjusted for vertical orientation. The orientation sensor operates similarly upon detection that the sight has conversely shifted from vertical to horizontal orientation. The orientation sensor and other components function in this manner whether the sight has been shifted manually or electronically. Internal software mechanics for alignment are automatically adjusted for vertical positioning when the clip-on sight is rotated by 90 degrees or used in that configuration. This action is an extension of menus provided by systems and methods described herein.

The functionality described herein of the orientation sensor and the clip-on thermal sight containing the sensor also applies when the sight is not physically attached to a firearm or used in a standalone configuration on a firearm. In embodiments, the clip-on thermal sight may not be physically attached to a firearm and may still function as described herein.

In an embodiment, a system is provided for extending the range of shooting. The system comprises a firearm and a standalone thermal sight attached to the firearm that receives rotation of 90 degrees lengthwise along the firearm. The system also displays orientation of view finder changed from horizontal to vertical, and improves, based at least on the rotation and changed orientation, resolution of user view. The standalone sight is similar to the clip-on sight but without day optic in front of it. What can be done with the clip-on sight can also be applied to the standalone thermal sight.

What is claimed is:

1. A system for extending range of shooting comprising:

a firearm with a day optic sight attached; and a clip-on thermal sight installed forward of the day optic sight and providing horizontal orientation that:

receives one of manual and electronic rotation of 90 degrees along a lengthwise axis of the firearm, displays orientation of view finder changed from horizontal to vertical based on the rotation along the lengthwise axis, and promotes improvement of resolution of user view based at least on the rotation and changed orientation, the promoted improvement extending a range of shooting of the firearm, wherein the promoted improvement is based on a combination of the day optic sight and the clip-on thermal sight and is further based on a relative rotation of the clip-on thermal sight to the day optic sight, and wherein the rotation and the changed orientation results in an adjustment of viewable menus including overlays and provides a view based on 1280 pixels equating to 80 milliradians (mils).

2. The system of claim 1, wherein the improved resolution of user view promotes practical ranges to target comprising at least one of detection range of about 9,900 yards, recognition range of about 3,100 yards, and identification range of about 1,900 yards.

3. The system of claim 1, wherein based at least on the rotation and changed orientation of view finder, aspect ratio is favorably altered.

4. The system of claim 1, wherein the rotation promotes improvement of elevation coverage by about 250% and promotes improvement of situational awareness by about 160%.

* * * * *